US005219462A

United States Patent [19]

Bruxvoort et al.

[11] Patent Number: 5,219,462

[45] Date of Patent: Jun. 15, 1993

[54] ABRASIVE ARTICLE HAVING ABRASIVE COMPOSITE MEMBERS POSITIONED IN RECESSES

[75] Inventors: Wesley J. Bruxvoort, Woodbury; Clyde D. Calhoun, Stillwater; Richard J. Webb, Inver Grove Heights, all of Minn.

[73] Assignee: Minnesota Mining and Manufacturing Company, St. Paul, Minn.

[21] Appl. No.: 819,755

[22] Filed: Jan. 13, 1992

[51] Int. Cl.[5] ..... B24D 3/00

[52] U.S. Cl. ..... 51/293; 51/295; 51/298; 51/307

[58] Field of Search ..... 51/293, 295, 298, 307

[56] References Cited

U.S. PATENT DOCUMENTS

| | | | |
|---|---|---|---|
| 29,808 | 10/1978 | Wagner | 51/401 |
| 794,495 | 7/1905 | Gorton | 51/295 |
| 1,657,784 | 1/1928 | Bergstrom | 51/293 |
| 1,941,962 | 1/1934 | Tone | 91/67.9 |
| 2,115,897 | 5/1938 | Woddell et al. | 51/188 |
| 2,292,261 | 8/1942 | Albertson | 51/295 |
| 2,410,506 | 11/1946 | Kirchner et al. | 51/188 |
| 2,984,052 | 5/1961 | Mueller | 51/188 |
| 3,116,574 | 1/1964 | Ciesielski | 51/185 |
| 3,121,298 | 2/1964 | Mellon | 51/195 |
| 3,246,430 | 4/1966 | Hurst | 51/402 |
| 3,991,527 | 11/1976 | Maran | 51/397 |
| 4,038,047 | 7/1977 | Haywood | 51/295 |
| 4,317,660 | 3/1982 | Kramis et al. | 51/295 |
| 4,331,489 | 5/1982 | Uehori et al. | 148/105 |
| 4,587,291 | 5/1986 | Gardziella et al. | 524/595 |
| 4,652,275 | 3/1987 | Bloecher et al. | 51/298 |
| 4,773,920 | 9/1988 | Chasman et al. | 41/295 |
| 4,799,939 | 1/1989 | Bloecher et al. | 51/293 |
| 4,866,885 | 9/1989 | Dodsworth | 51/295 |
| 4,904,280 | 2/1990 | Cygan et al. | 51/296 |
| 4,925,457 | 5/1990 | deKok et al. | 51/293 |
| 4,930,266 | 6/1990 | Calhoun et al. | 51/293 |
| 5,014,468 | 5/1991 | Ravipati et al. | 51/295 |
| 5,015,266 | 5/1991 | Yamamoto | 51/293 |

FOREIGN PATENT DOCUMENTS 0434378 6/1991 European Pat. Off. .

*Primary Examiner*—Mark L. Bell
*Assistant Examiner*—Willie J. Thompson
*Attorney, Agent, or Firm*—Gary L. Griswold; Walter N. Kirn; David L. Weinstein

[57] ABSTRACT

The present invention provides an abrasive article that has abrasive composite members secured firmly in recesses in a backing sheet in a precise pattern whereby there is desired lateral spacing between each abrasive composite member. The present invention also provides a method for preparing the abrasive article comprising the steps of providing an embossed backing sheet having a plurality of recesses in the front surface of the backing sheet. The recesses are filled with an abrasive slurry that includes a plurality of abrasive grains dispersed in a binder precursor. An expanding agent is also provided in the recesses, either separate from the slurry or dispersed in the slurry. The expanding agent, when activated, expands the abrasive slurry outward and above the front surface of the embossed backing sheet. After the binder precursor of the abrasive slurry is hardened, individual abrasive composite members extend above the front surface of the embossed backing sheet. An alternative embodiment provides recesses that extend completely through the embossed backing sheet, so that abrasive composite members protrude from the front surface and from the back surface of the embossed backing sheet.

40 Claims, 2 Drawing Sheets

ABRASIVE ARTICLE HAVING ABRASIVE COMPOSITE MEMBERS POSITIONED IN RECESSES

TECHNICAL FIELD OF THE INVENTION

This invention relates to abrasive articles, and more particularly, to a coated abrasive article having an embossed backing containing recesses that carry abrasive composite members therein.

BACKGROUND OF THE INVENTION

Abrasive articles have long been known in the art, and have been used to abrade, finish, and polish a variety of surfaces. In its most basic form, a coated abrasive article comprises abrasive grains adhered to a backing. Paper and cloth have long been used as backing materials for coated abrasive articles. The abrasive grains may also be adhered to other types of backings, including inflexible backings.

Coarse-grade abrasive articles are used for rough sanding or abrading of a workpiece. At the other end of the spectrum, extremely fine abrasive grains, sometimes called microabrasive grains, are incorporated into coated abrasive articles and used to achieve a close tolerance finish or polish. Coated abrasive articles containing microabrasive grains are used, for example, for magnetic head finishing; polishing or burnishing floppy disks; creating high gloss finishes on an acrylic surface; and providing a final finish to stainless steel or brass.

Whether using microabrasive grains, coarse-grade abrasive grains, or other types of abrasive grains, the abrading surface of a coated abrasive article can be clogged or gummed by materials worn from the workpiece. One way this problem has been addressed is by applying the abrasive grains to the surface of a backing in a dot pattern or matrix. See, for example, U.S. Pat. Nos. 3,246,430 (Hurst); 794,495 (Gorton); 1,657,784 (Bergstrom); 4,317,660 (Kramis et al.). When abrasive grains are disposed in a pattern, pathways exist for abraded material to be removed.

Coated abrasive articles having abrasive grains arranged in a dot pattern have been made by applying adhesive to a backing in a desired dot pattern. The surface is then flooded with abrasive grains that adhere to the dots of adhesive. This method typically provides multiple abrasive grains at each adhesive position. Alternatively, the adhesive can be continuous and the abrasive grains can be applied in a desired pattern.

Other types of abrasive tools have been made by setting abrasive granules, such as diamonds, into a desired pattern by hand. It does not appear that hand setting of large abrasive granules, such as diamonds, has been employed in a commercially available flexible coated abrasive article.

Abrasive grains, even when tightly graded, vary in size, and are typically of an irregular shape. Some of the problems caused by the irregularly sized and shaped grains have been addressed by using spherical agglomerates of roughly equal size. However, even when tightly graded spherical agglomerates have been used, the inability to regulate the number and position of abrasive grains or agglomerates continues to cause problems, such as uneven cutting rates, and scratches of unacceptable dimensions. These problems are accentuated in microabrasive applications.

U.S. Pat. No. 4,930,266 (Calhoun et al.) discloses an abrasive article able to produce fine finishes at high cutting rates. Calhoun et al. disclose a printing process to position individual abrasive grains or agglomerates in a regular, predetermined pattern. Thus, the article described in Calhoun et al. provides an abrasive article that is able to produce a relatively predictable, consistent, and repeatable finish.

However, there remains a need for an abrasive article that can provide a predictable, consistent, repeatable finish to a surface. There is also a need for an abrasive article in which abraded material can be easily removed from the surface of the abrasive article.

SUMMARY OF THE INVENTION

The present invention provides an abrasive article that can provide a predictable, consistent, repeatable finish to a surface, with a predictable cutting rate. The method of manufacturing the abrasive article of the present invention is efficient, and is able to produce an abrasive article that has abrasive composite members secured firmly in recesses in a backing sheet in a precise pattern, with the desired lateral spacing between each abrasive composite member. Each abrasive composite member comprises abrasive grains dispersed in a binder. It is preferred that the abrasive composite members comprise 5 to 95% by weight abrasive grains.

According to the method of the present invention, an embossed backing sheet, having a front surface and back surface, the front surface having a plurality of recesses, the recesses having a recessed surface portion and a side wall portion is provided. The side wall portions extend between the front surface and the recessed surface portions, thereby defining the plurality of recesses in the front surface of the backing sheet.

The recesses are filled with an abrasive slurry comprising a plurality of abrasive grains dispersed in a binder precursor. An expanding agent is also provided in the recess, either separate from the slurry or dispersed in the slurry. The expanding agent, when activated, causes the abrasive slurry to expand outward and above the front surface of the embossed backing sheet. After the binder precursor hardens, individual abrasive composite members extend above the front surface of the embossed backing sheet. To further secure the abrasive composite members to the embossed backing sheet, a size coat may be applied over the front surface of the embossed backing sheet and the abrasive composite members.

In an alternative embodiment, the recesses can be extended through the embossed backing sheet. In this embodiment, the expanding agent acts to force the abrasive slurry outward beyond both the front surface and the back surface to provide abrasive composite members that protrude from each side of the embossed backing sheet. To further secure the abrasive composite members to the embossed backing sheet, a size coat may be applied over the front surface or back surface or both surfaces of the embossed backing sheet.

"Embossed backing sheet," as used herein, includes backing sheets that have recesses that extend partially or entirely through the backing sheet, or both. The embossed backing sheet may be made up of one or more layers, at least one of which must be embossed. Thus, the recesses may be made in a surface layer that is laminated to a second layer. In an embossed backing sheet having more than one layer, the layers may be made of the same or of different materials.

The method of the present invention permits extremely precise and close spacing of the abrasive composite members, whether measured in terms of area spacing (members/$cm^2$), or linear spacing (members per linear centimeter), or otherwise. When measuring linear spacing the number of abrasive composite members is measured in the direction resulting in the highest count.

"Precise", as used herein, refers to the placement of individual abrasive composite members on an embossed backing sheet in a predetermined pattern. The lateral spacing between precisely spaced individual abrasive composite members is not necessarily the same, but the abrasive composite members are spaced as desired for the particular application.

"Regular", as used herein, refers to spacing the abrasive composite members in a pattern in a particular linear direction such that the distance between adjacent abrasive composite members is substantially the same. For example, a regular array may have rows and columns of abrasive composite members with each row spaced at a distance X from each adjacent row, and each column of members spaced a distance Y from each adjacent column.

DETAILED DESCRIPTION OF THE PRESENT INVENTION

The present invention provides an abrasive article comprising an embossed backing sheet having recessed portions having abrasive composite members extending therefrom. The abrasive composite members comprise abrasive grains dispersed in a binder.

FIGS. 1 through 6 schematically depict abrasive articles of the present invention and portions thereof. These figures are not necessarily to scale, but are scaled so as to best exemplify the components, and their relationships.

Figure 1:
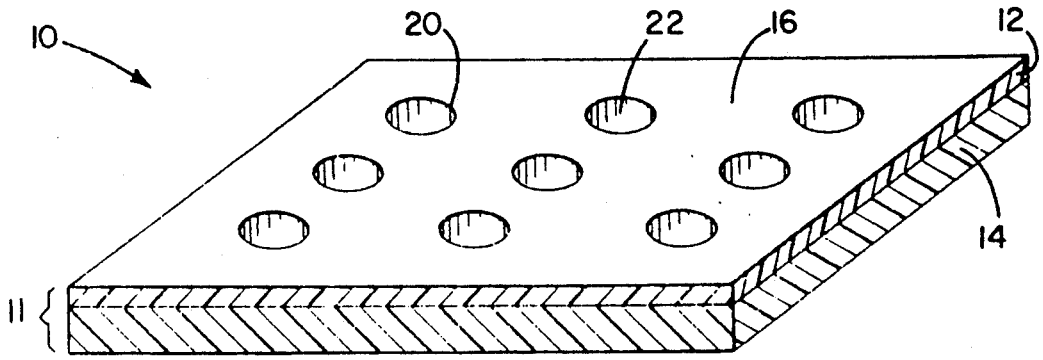
FIG. 1 is a schematic perspective view of an embossed backing sheet having a backing layer, prior to application of the abrasive slurry.

Referring to FIG. 1, a partial abrasive article generally designated 10 having an embossed backing sheet 11 having a surface layer 12 and a backing layer 14 is shown. The surface layer 12 has a front surface 16 that includes recesses 20. The recesses 20 include side wall portions 22 and recessed surface portions (not shown).

Figure 2:
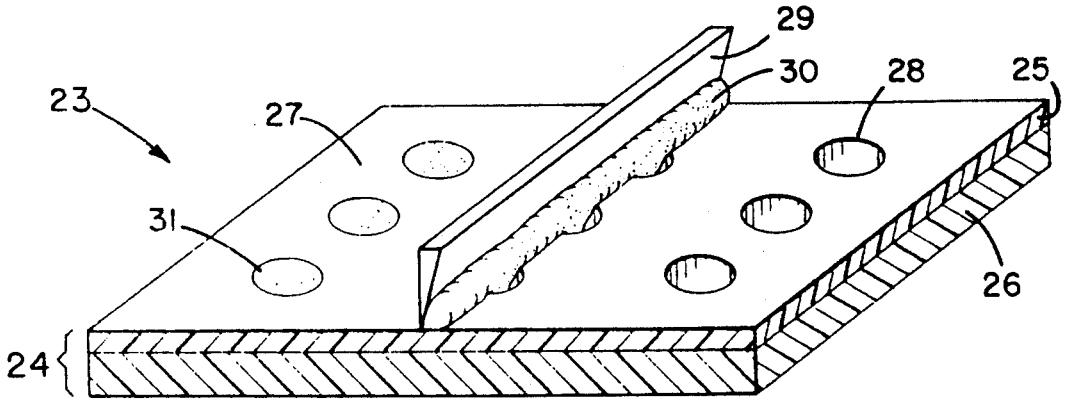
FIG. 2 is a schematic perspective view showing an abrasive slurry being coated into the recesses of an embossed backing sheet.

Referring to FIG. 2, a partial abrasive article generally designated 23 having an embossed backing sheet 24 having a surface layer 25 and a backing layer 26 is shown. The surface layer 25 includes a front surface 27 and recesses 28. A doctor blade 29 is shown coating an abrasive slurry 30 into the recesses 28. Filled recesses 31 are also shown.

Figure 3:
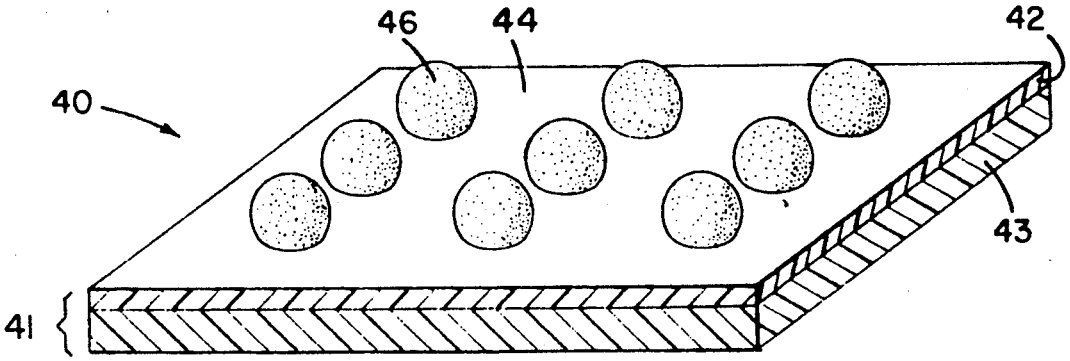
FIG. 3 is a schematic perspective view of an abrasive article of the present invention after the expanding agent has been activated.

Referring to FIG. 3, an abrasive article generally designated 40, having an embossed backing sheet 41 having a surface layer 42 and a backing layer 43 is shown. The surface layer 42 includes a front surface 44 having abrasive composite members 46 projecting therefrom.

Figure 4:
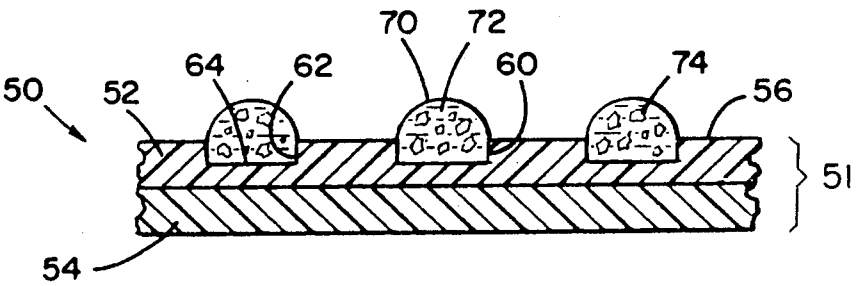
FIG. 4 is a schematic cross-sectional view of an abrasive article of the present invention.

Referring to FIG. 4, a cross-sectional view of an abrasive article 50 is shown. The abrasive article 50 .includes an embossed backing sheet 51 having a surface layer 52 and a backing layer 54. The surface layer 52 includes a front surface 56 and recesses 60. Each recess 60 includes a side wall portion 62 and a recessed surface portion 64. An abrasive composite member 70 is provided in each recess 60. Each abrasive composite member 70 comprises binder 72 and abrasive grains 74. The expanding agent (not shown) may be dispersed throughout the abrasive composite member 70, or can be provided elsewhere in the recesses 60.

Figure 5:
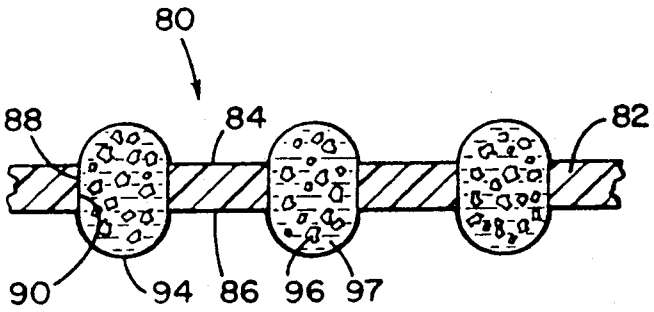
FIG. 5 is a schematic cross-sectional view of an abrasive article of the present invention.

Referring to FIG. 5, a cross-sectional view of another embodiment of the present invention is shown. An abrasive article 80 includes an embossed backing sheet 82, having a front surface 84 and a back surface 86. The embossed backing sheet 82 also includes recesses 88 that extend completely through the embossed backing sheet. The recesses have side walls 90. The abrasive article 80 comprises abrasive composite members 94 extending from the front surface 84 and the back surface 86 of the embossed backing sheet 82. The abrasive composite member 94 comprises abrasive grains 96 and binder 97.

Figure 6:
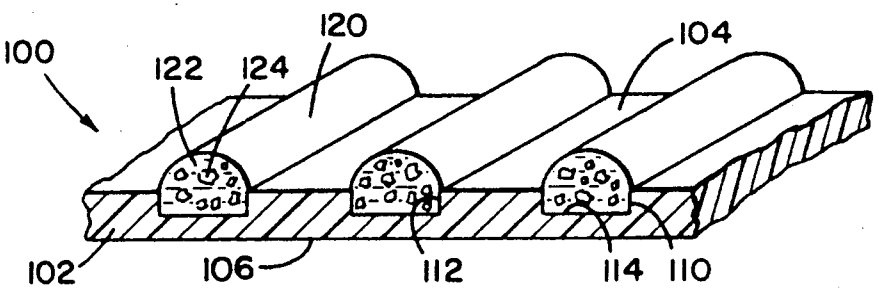
FIG. 6 is a schematic cross-sectional view of an abrasive article of the present invention.

Referring to FIG. 6, an abrasive article 100 having longitudinally extending abrasive composite members is shown. In FIG. 6, the abrasive article 100 includes an embossed backing sheet 102, having a front surface 104 and a back surface 106. The front surface 104 has recesses 110. The recesses 110 have side wall portions 112 and recessed surface portions 114. Each recess 110 contains an elongated abrasive composite member 120. The abrasive composite member 120 comprises binder 122 and abrasive grains 124.

Figure 7:
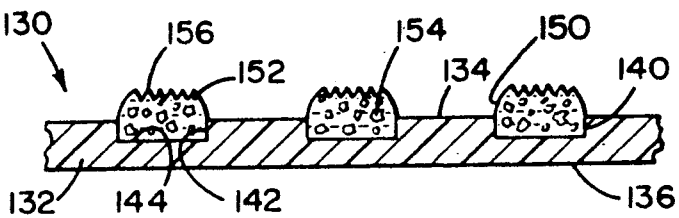
FIG. 7 is a schematic cross-sectional view of an abrasive article of the present invention.

Referring to FIG. 7, an abrasive article 130 is shown. The abrasive article 130 includes an embossed backing sheet 132 having a front surface 134 and a back surface 136. The front surface 134 has recesses 140. Each recess has side walls 142 and a recessed surface portion 144. Each recess 140 contains an abrasive composite member 150. Each abrasive composite member 150 comprises binder 152 and abrasive grains 154. A jagged surface 156 has been formed in each abrasive composite member 150. In FIG. 7, the top surface of the abrasive composite member 150 has been given a jagged or saw tooth pattern. This, or some other, surface topography may be formed by a number of means, such as by placing a mold containing the inverse of the desired topography over the abrasive slurry prior to the hardening of the binder precursor. When the abrasive slurry expands and solidifies, the top surface of each abrasive composite member will take the topography of the mold, for example, the jagged shape shown in FIG. 7. By employing a mold having a uniform depth, a uniform height can be imparted to the abrasive composite members. As used herein, "uniform" means within 10% of the mean.

In the present invention, the abrasive composite members are provided only in the recesses and will extend above the front surface of the embossed backing sheet (or above the front and back surface where the recesses extend completely through the embossed backing sheet). Because of imperfect manufacturing techniques, small amounts of material for preparing abrasive composite members may be present on the front or back surface of the embossed backing sheet. In general, it is preferred that at least 80%, most preferably at least 90%, of the material for preparing abrasive composite members be provided in the recesses and directly above the portion of the surface having the recesses.

There are several advantages to having a precise pattern of abrasive composite members. The presence of the areas free of abrasive composite members between the individual abrasive composite members tends to reduce the amount of loading, a term used to describe the filling of space between abrasive grains or abrasive composite members with swarf (the material removed from the workpiece being abraded or sanded) and the subsequent build-up of that material. For example, in wood sanding, wood particles are lodged between abrasive grains, dramatically reducing the cutting ability of the abrasive grains. Also, the presence of the areas free of abrasive composite members tends to make the resulting abrasive article more flexible. A further advantage is that a precise pattern of the abrasive composite members can be designed to give the optimum cut for a given abrading application. A precise pattern of abrasive composite members also permits abrading to be accomplished only in those areas in which abrading is necessary. For example, in a disc application, there can be a progressively higher density of abrasive composite members as one proceeds radially from the center of the disc.

Embossed Backing Sheet

In general, the embossed backing sheet used in the present invention may be embossed by any technique that provides a plurality of recesses in (or through) the embossed backing sheet. Suitable techniques for forming recesses include thermal embossing, chill casting, casting, extrusion, photoresist, thermal treating, chemical etching, and laser treating. Suitable techniques for providing recesses that extend completely through the embossed backing sheet include laser drilling and mechanical punching.

The embossed backing sheet can be made of any material that is capable of having recesses formed in a front surface. Examples of such materials include paper, mesh materials, metals, glass, polymeric films, e.g. thermosetting resins and thermoplastic resins The preferred materials are thermoplastic resins. Examples of suitable thermoplastic resins include polyamides, polyolefins, e.g., polyethylene, polypropylene, polyester, and ethylene acrylic acid. B stage thermosetting resins can also be used, as they are in a thermoplastic state.

In thermal embossing, the backing sheet is pressed between two heated rolls, one of which is an embossing roll. In a thermal embossing technique, it is preferred that the portion of the backing sheet to be embossed be a thermoplastic film. Thus, a coating of a thermoplastic film may be provided on a layer of non-thermoplastic material. The casting technique comprises the steps of casting or extruding a polymer onto an embossing roll, and curing or cooling the polymer to form the embossed backing sheet. The photoresist technique for forming recesses involves the step of exposing certain areas of the backing sheet to ultraviolet light. For a positive acting photoresist, the areas of the backing sheet that are exposed are then removed, and the areas that are not exposed remain. Embossing techniques are further described in H. C. Park, "Films, Manufacture", Encyclopedia of Polymer Science and Engineering, Second Edition, Volume 7, p. 105 (1987) and J. Briston, "Plastic Films", Second Edition, Longman, Inc., NY 1983, both incorporated herein by reference.

The recesses in the front surface of the embossed backing sheet can have any shape. For example, the planar shape of the recesses can be rectangular, semicircular, circular, triangular, square, hexagonal, octagonal, or other desired shape. The recesses can be linked together or unconnected, and can have any shape such as a cube, a truncated cone, a truncated pyramid, a hemisphere or other portion of a sphere, a trough having vertical sides, such as an extended linear recess, a trough having non-vertical sides, or any other shape of recess.

The height of the side wall portion (e.g., side wall 62 in FIG. 4) may be varied as desired. The height of the side wall portion will be determined on the basis of several factors, such as, for example, the pattern specified, the binder, the abrasive grain size, and the desired use for the abrasive article. The height of the side wall portion will typically be about 10 to 1000 micrometers, preferably 10 to 100 micrometers, and more preferably 10 to 50 micrometers. Where the recesses are unconnected, the recessed surface portion typically has a maximum dimension of 10 to 5000 micrometers. The unconnected recesses typically have an area spacing such that there are 2 to 10,000 recesses/$cm^2$, preferably 100 to 1,000 recesses/$cm^2$. Where the recesses are linked together so as to form a linearly elongated recess (e.g., FIG. 6), the linearly elongated recesses typically have a linear spacing such that there are 2 to 100 recesses/cm.

The embossed backing sheet, e.g., layer 12 in FIG. 1, may be erodible. In some instances, an embossed backing sheet may be erodible only under certain conditions. For example, if the abrading is done in water or oil, the embossed backing sheet may be sensitive to either water or oil such that it breaks down or wears away faster than the abrasive composite members. For example, if the abrading is carried out in oil, then paraffin wax can be used as the erodible material because paraffin wax is soluble in oil. On the other hand, if the abrading is carried out in water, then polyvinyl alcohol can be used as the erodible material because polyvinyl alcohol is soluble in water. An erodible embossed backing sheet may be desirable to permit additional portions of the abrasive composite members residing in the recesses to be utilized.

Abrasive Composite Members

The abrasive composite members that fill the recesses of the embossed backing sheet of the abrasive articles of the present invention provide an abrasive member that is in essence self-sharpening. In other words, as the abrasive article is used, abrasive grains are sloughed off from the abrasive composite members and unused abrasive grains are exposed. This provides an abrasive article that has a long life, high sustained cut rate, and a relatively consistent surface finish over the life of the article.

The abrasive composite members are disposed in a precise and reproducible pattern. The abrasive composite members comprise binder and abrasive grains.

The abrasive composite members can be formed from an abrasive slurry. The abrasive slurry comprises a binder precursor having abrasive grains dispersed therein. The binder precursor is typically a liquid that is capable of flowing and being coated by known techniques. During the manufacture of the abrasive article, the abrasive slurry is applied to the embossed backing sheet. Each recess is filled, typically flush with the front surface of the embossed backing sheet. During further processing of the abrasive article, the binder precursor is cured, polymerized, dried, or otherwise solidified or hardened, to a solid that is not flowable, whereby the abrasive composite member includes a solidified binder. The expanding agent may be dispersed throughout the abrasive slurry, or may be applied to the recesses prior to or after application of the abrasive slurry to the recesses.

The abrasive composite members of the invention can be formed in situ during the manufacture of the abrasive article. The abrasive composite members are essentially "grown" from the recesses. Typically, the abrasive composite members will extend at least two micrometers above the front surface of the embossed backing sheet, and more typically at least five micrometers. In most applications, the abrasive composite members will not extend more than 2000 micrometers above the front surface of the embossed backing sheet.

As discussed above, it is preferred that the abrasive composite member be provided only in and above the recesses. To achieve this, the abrasive slurry is preferably applied only in the recesses of the embossed backing sheet. This can be accomplished, for example, by flooding the entire surface, i.e., the front surface and the recesses, of the embossed backing sheet with the abrasive slurry, and removing the excess abrasive slurry by means of a doctor blade, or similar means for scraping the front surface clean.

Binders

Examples of binder precursors include: phenolic resins, urea-formaldehyde resins, melamine formaldehyde resins, hyde glue, aminoplast resins, epoxy resins, acrylate resins, polyester resins, urethane resins, and mixtures thereof. The binder precursor may also contain a curing agent, catalyst, or initiator, to initiate the polymerization of the above-mentioned resins.

The binder precursor may also contain an organic solvent or water to lower the viscosity of the abrasive slurry. Typically the viscosity will range from 100 to 10,000 centipoises at room temperature. During the manufacture of the abrasive article, the organic solvent or water will be removed, typically by heating.

Phenolic resins have excellent thermal properties, are readily available, are low in cost, and are easy to handle. There are two types of phenolic resins, resol and novalac. Resol phenolic resins are activated by alkaline catalysts, and typically have a ratio of formaldehyde to phenol of greater than or equal to one, typically between 1.5:1 to 3.0:1. Alkaline catalysts suitable for these resins include sodium hydroxide, barium hydroxide, potassium hydroxide, calcium hydroxide, organic amines, and sodium carbonate. Resol phenolic resins are thermosetting resins, and, in the cured form, exhibit excellent toughness, dimensional stability, strength, hardness, and heat resistance.

A preferred binder precursor is a phenolic resin, more preferably a rapid curing phenolic resin, such as one of the acid cured resol phenolic resins disclosed in U.S. Pat. No. 4,587,291, incorporated herein by reference.

Both resol and novalac phenolic resins, with the addition of the appropriate curable agent or initiator, are cured by heat. Examples of suitable commercially available phenolic resins include: "VARCUM", from Occidental Chemical Corporation; "AEROFENE", from Ashland Chemical Co.; "BAKELITE", from Union Carbide; and "RESINOX", from Monsanto.

Epoxy resins suitable for this invention include monomeric epoxy compounds and polymeric epoxy compounds, and may vary greatly in the nature of their backbones and substituent groups. For example, the backbone may be of any type, and substituent groups thereon can be any group free of an active hydrogen atom, which is reactive with an oxirane ring at room temperature. Representative examples of acceptable substituent groups include: halogens, ester groups, ether groups, sulfonate groups, siloxane groups, nitro groups, and phosphate groups. The molecular weights of the epoxy resins typically range from about 50 to about 5,000, and preferably range from about 100 to about 1000. Mixtures of various epoxy resins can be used in the compositions o this invention.

Acrylate resins are also suitable for use as a binder precursor. Acrylate resins suitable for the binder precursor preferably have a molecular weight of less than about 5,000 and are preferably esters of (1) compounds containing aliphatic monohydroxy and polyhydroxy groups and (2) unsaturated carboxylic acids.

Representative examples of acrylate resins suitable for this invention include methyl methacrylate, ethyl methacrylate, styrene, divinylbenzene, vinyl toluene, ethylene glycol diacrylate and methacrylate, hexanediol diacrylate, triethylene glycol diacrylate and methacrylate, trimethylolpropane triacrylate, glycerol triacrylate, pentaerythritol triacrylate and methacrylate, pentaerythritol tetraacrylate and methacrylate, dipentaerythritol pentaacrylate, sorbitol triacrylate, sorbitor hexacrylate, bisphenol A diacrylate, and ethoxylated bisphenol A diacrylate.

The polymerization or curing of the acrylate resins is initiated by a free radical source. The free radical source may be electron beam radiation or an appropriate curing agent or initiator. When a curing agent or initiator is exposed to an energy source such as heat or radiation energy (electron beam, ultraviolet light, or visible light), the curing agent or initiator will initiate polymerization of the acrylate.

The rate of curing of the binder precursor varies according to the thickness of the binder precursor as well as the density and character of the abrasive slurry.

Abrasive Grain

The abrasive grain size is typically 0.1 micrometer to 1,000 micrometers, and preferably 0.5 to 50 micrometers. When large size abrasive grains are employed, care must be taken in the selection of the expanding agent to allow for proper expansion of the abrasive slurry. Additionally, it is preferred that the size distribution of the abrasive grains be tightly controlled. A narrow range of abrasive grain size results in an abrasive article that produces a more consistent finish on the workpiece being abraded. Of course, it may be desirable to include in the abrasive composite member grains of two or more different sizes, or to have different types of abrasive composite members, with each type including abrasive grains of a particular size.

Examples of abrasive grains suitable for this invention include: fused alumina, heat treated alumina, ceramic aluminum oxide, silicon carbide, alumina zirconia, garnet, diamond, cubic boron nitride, diamond-like materials, ceria, ferric oxide, silica, and mixtures thereof.

The term "abrasive grain" is also meant to encompass agglomerates. An agglomerate is a plurality of abrasive grains bonded together. Agglomerates are well known in the art and can be made by any suitable technique, such as those described in U.S. Pat. Nos. 29,808; 4,331,489; 4,652,275; and 4,799,939, incorporated herein by reference.

In abrasive composite members used in the present invention, the abrasive grain will typically be present at a concentration of 5 to 95%, by weight. This weight ratio will vary, depending upon the abrasive grain size and the type of binder employed.

The abrasive grain used in each abrasive composite member may be of uniform size, or may be of more than one size. For example, a large grain and a smaller grain may be mixed throughout an abrasive composite member. Alternatively, the larger grain may be positioned in the top portion of an abrasive composite member with a smaller grain positioned in a lower portion of the abrasive composite member. This may be accomplished by, for example, coating an abrasive slurry having the smaller abrasive grains prior to coating a second layer of abrasive slurry having the larger grains. Also, one or more types of abrasive composite member, each having a grain of a different size, may be utilized.

Other Additives

Abrasive composite members may contain other materials besides the abrasive grains and the binder. These materials, referred to as additives, include coupling agents, wetting agents, dyes, pigments, fibers, plasticizers, fillers, grinding aids, antistatic agents, loading resistant agents, and mixtures thereof.

It may be desirable for the abrasive composite members to contain a coupling agent. Examples of suitable coupling agents include organosilanes, zircoaluminates, and titanates. The coupling agent will generally be present at a concentration of less then 5 percent by weight, preferably less than 1 percent by weight of the abrasive composite member.

Expanding Agent

An expanding agent may be applied to the recesses in the embossed backing sheet apart from the abrasive slurry, or the expanding agent may be mixed with the abrasive slurry before it is applied to the recesses. For example, the expanding agent can be applied to the recess 60 as shown in FIG. 4, prior to introduction of the abrasive slurry to the recess. During the hardening of the binder precursor, the expanding agent will cause the abrasive slurry to increase in volume sufficiently to expand above the front surface of the embossed backing sheet as it is forming into the hardened abrasive composite member (e.g., above the front surface 56 shown in FIG. 4). In addition, the expanding agent would be expected to provide a degree of porosity to the hardened abrasive composite member.

The expanding agent can be any substance capable of increasing the volume occupied by the abrasive slurry. For example, the expanding agent can be steam or an organic solvent capable of swelling the abrasive slurry. Other examples of expanding agents include nitrogen gas, carbon dioxide gas, air, pentane, hexane, heptane, butene, $CFCl_3$, vermiculite, toluene diisocyanate, 4,4''-diphenylmethane diisocyanate, hexamethylene diisocyanate, and polyurethane prepolymer, which, when reacted with water, generates carbon dioxide gas. Other expanding agents include expanding agents that decompose, such as ammonium carbonate, ammonium bicarbonate, sodium bicarbonate, dinitropentamethylenetetramine, azodicarbonamide, azobisisobutylonitrile, hydrazine compounds such as maleic acid hydrazide, oxalic acid hydrazide, benzenesulfonyl hydrazide, toluenesulfonyl hydrazide, p,p' hydroxybis (benzenesulfonylhydrazide), and t-alkylhydrazonium salt. The expanding agent may include two or more expanding agents in combination.

A preferred expanding agent is an expanding bead commercially available from the Kema Nobel Company, Sudsvall, Sweden, under the trade designation "EXPANCEL 551 DU."

To maximize the effectiveness of the expanding agent, it is preferred that the average size of the abrasive grains be less than 30 micrometers. In some instances, the binder precursor and the expanding agent may be the same. Some binder precursors, by themselves, will cause the abrasive slurry to expand or increase in volume. Certain polyurethane binder precursors will have this effect (e.g., "HYPOL" polyurethane resin).

The porosity of the abrasive composite members may be varied through the use of different binders and expanding agents. Porosity, if desired, can vary from 5 to 95% by volume, and can preferably range from 40 to 80% by volume. The porosity value may vary depending upon a number of factors, such as the abrasive grain size, the binder, and the particular application in which the abrasive article is intended to be used.

Size Coat

Abrasive composite members may be further secured to the embossed backing sheet by means of a size coat. The size coat can be any adhesive material, such as phenolic resins, urea-formaldehyde resins, melamine formaldehyde resins, hyde glue, aminoplast resins, epoxy resins, acrylate resins, latexes, polyester resins, urethane resins, and mixtures thereof. The size coat can also be selected from the group of binder precursors described above. In addition, the size coat can contain other additives such as fillers, grinding aids, pigments, coupling agents, dyes, and wetting agents.

The present invention is further described in the following non-limiting examples, wherein all parts are by weight.

EXAMPLES

The following designations are used throughout the examples:

| | |
|---|---|
| WAO | white fused alumina abrasive grain; |
| EXB | expanding beads commercially available from the Kema Nobel Company, Sundsvall, Sweden under the trade designation "Expancel 551 DU"; |
| NR | novalac resin; |
| SOL | glycol ether solvent; |
| EAA | ethylene acrylic acid copolymer; and |
| PET | polyethylene terephthalate film. |

The following test methods were used in the examples.

Rigid Disc Texturing Test

The rigid disc texturing test provides a texture to a rigid disc with an abrasive article of the present invention. A model 800C HDF rigid disc burnisher, manufactured by Exclusive Design Co., San Mateo, Calif., was used. The rigid disc workpiece was a nickel plated aluminum disc (130 mm diameter) rotated at 900 rpm. The abrasive article of the present invention was cut into a 5.1 cm wide abrasive strip having an extended length. Rolls of the abrasive strip were installed on a tape cassette that had a supply reel with the unused abrasive article and a take up reel with the used abrasive article. Two sets of abrasive tape cassettes were tested. One cassette was used to texturize the top surface of the rigid disc, and one cassette was used to texturize the bottom surface of the rigid disc. The rate of feed of the abrasive tape was 39 cm/min. During the texturizing process a water mist was applied to the surface of the rigid disc. Two cleaning tape cassettes (type TJ cleaning tape, manufactured by WEST) were also used in this test. One cassette was used to clean the top surface of the rigid disc, and one cassette was used to clean the bottom surface of the rigid disc. At the surfaces of the rigid disc, the abrasive tapes and cleaning tapes were passed over a 50 durometer roller. The endpoint of the test was three cycles and the duration of each cycle was 1.8 seconds. At the endpoint of the test, the surface of the rigid disc was measured by a reflectometer. The reflectometer was a HD 1000 relative surface texture profiler. The industry standards for this test are a mean value 4.39 to 4.67, a peak to peak value of 0.05 to 0.19, and a slope value of 0 to 0.28.

Ophthalmic Test

A pressure-sensitive adhesive was laminated to the non-abrasive side of the abrasive article to be tested. An ophthalmic test daisy (7.6 cm diameter) was cut from the abrasive article to be tested by means of a standard die. The test daisy was mounted on a 2.12 diopter spherical lapping block. The lapping block was mounted on a Coburn Rocket Model 505 lapping machine. The initial thickness of the lens, i.e., the workpiece, was measured before the lens was clamped over the lapping block. The air pressure was set at 138 KPa. The lens and lapping blocks were flooded with water. The lens was abraded, then removed, and the final thickness of the lens was measured. The amount of lens material removed was the difference between the initial and final thicknesses. The lens was made of polycarbonate. The end point of the test was two minutes.

Wet Push Pull Test

The abrasive article to be tested was cut into a 5.6 cm by 22.9 cm rectangular sheet. The abrasive article was secured by means of clips to a 4.5 kg back-up pad having the form of a metal block . The abrasive surface contacting the workpiece was 5.6 cm by 15.1 cm. The workpiece was a 45 cm by 77 cm metal plate that had been coated with an automotive urethane paint primer. During abrading, the surface of the workpiece was flooded with water. The abrasive article/back-up pad assembly was moved 10 cycles against the workpiece to abrade the urethane primer. A cycle was the movement of the operator's hand in a straight line in a back and forth motion. The surface finish of the workpiece abraded was measured after 10 cycles. The surface finish (Ra and Rtm) was measured using a Surtronic 3 profilometer manufactured by Rauk Taylor Hobson Limited.

Disc Test Procedure

The abrasive article to be tested was cut into a 10.2 cm diameter disc and secured to a foam back-up pad by means of a pressure-sensitive adhesive. The abrasive disc/back-up pad assembly was installed on a Scheifer testing machine to abrade a polymethyl methacrylate "PLEXIGLASS" workpiece. All of the testing was done underneath a water flow. The cut was measured every 500 revolutions or cycles of the abrasive disc.

The following comparative examples were used for comparison with examples of abrasive articles of the present invention.

Comparative Example A

The abrasive article for Control Example A was 2 micron Imperial® Microfinishing lapping film, commercially available from Minnesota Mining and Manufacturing Company, St. Paul, Minn.

Comparative Example B

The abrasive article for Control Example B was 12 micron Imperial® Microfinishing lapping film, commercially available from Minnesota Mining and Manufacturing Company, St. Paul, Minn.

Comparative Example C

The abrasive article for Control Example C was a grade 1500 Microfine Imperial® WetorDry paper®, commercially available from Minnesota Mining and Manufacturing Company, St. Paul, Minn.

Example 1

An abrasive article of the present invention was prepared as follows. An abrasive slurry was prepared by homogeneously mixing the following materials: 50.5 parts WAO having an average particle size of about 12 micrometers; 2.5 parts EXB; 24 parts NR; 8 parts SOL; 13.5 parts isopropyl alcohol; and 1.5 parts water. The embossed backing sheet used in this example consisted of a layer of polyethylene (37 micrometers thick) coated onto a film of PET (50 micrometers thick). The polyethylene layer was embossed to have 25 recesses/cm arranged in a square lattice array to provide 625 recesses/cm$^2$. A square lattice array is a regular array. Each recess was in the shape of an inverted truncated cone having diameters of about 0.08 mm at the surface and 0.065 mm at its depth, which was 0.015 mm. A silicone release coating was provided on the front surface of the embossed backing sheet. This silicone release coating was not provided in the recesses. The front surface of the embossed backing sheet was flooded with the abrasive slurry such that the abrasive slurry was present on the front surface and in the recesses of the embossed backing sheet. A doctor blade was used to remove the abrasive slurry from the front surface of the embossed backing sheet. The resulting article was then heated for 10 minutes at a temperature of 112° C. to expand and polymerize the phenolic resin and activate the expanding agent.

Example 2

An abrasive article of the present invention was prepared in the same manner as was used in Example 1, except that a layer of EAA (17.5 micrometers thick) was substituted for the polyethylene layer of Example 1.

Example 3

An abrasive article of the present invention was prepared in the same manner as was used in Example 2, except that the abrasive slurry was heated for 30 minutes at a temperature of 112° C. The adhesion of the abrasive composite members to the embossed backing sheet was greater for the article of Example 3 than for that of either Example 1 or Example 2.

Example 4

An abrasive article of the present invention was prepared in the same manner as was used in Example 3, except that the abrasive slurry was heated for 20 minutes at a temperature of 128° C.

Example 5

An abrasive article of the present invention was prepared in the same manner as was used in Example 4, except that a different abrasive slurry was employed. The abrasive slurry consisted of 74 parts WAO having an average particle size of between 10 to 12 micrometers; 2.5 parts EXB; 8 parts NR; 25 parts SOL, 12 parts isopropyl alcohol; and 1.5 parts water.

EXAMPLE 6

An abrasive article of the present invention was prepared as follows. An abrasive slurry was prepared by homogeneously mixing the following materials: 56 parts WAO having an average particle size of between 10 to 12 micrometers, 2.5 parts EXB, 20.5 parts NR, 7 parts SOL, 13 parts isopropyl alcohol, and 1.5 parts water. The embossed backing sheet of the type used in Example 2 was flooded with the abrasive slurry such that the abrasive slurry was present on the front surface and in the recesses of the embossed backing sheet. A doctor blade was used to remove the abrasive slurry from the front surface of the embossed backing sheet. The resulting article was then heated for 20 minutes at a temperature of 120° C. to expand and polymerize the phenolic resin. Abrasive composite members extending about 0.02 mm above the front surface of the embossed backing sheet were formed.

Example 7

An abrasive article of the present invention was prepared in the same manner as was used in Example 6, except that no silicone release coating was employed.

The abrasive article was tested according to the ophthalmic test and was found to remove 45% more material from the abraded surface than did the abrasive article of Comparative Example B.

The abrasive article of this example was tested according to the Push Pull Test and produced a surface having a Ra of 0.2 micrometer and a Rtm value of 1.55 micrometers. In comparison, Comparative Example C produced a surface having a Ra value of 0.23 micrometer and a Rtm value of 1.58 micrometers.

The abrasive article of the invention was tested according to the Disc Test Procedure. The results are set forth in Table I.

TABLE I

| | Disc Test Procedure Results Cut in grams | |
|---|---|---|
| No. of cycles | Example 7 | Comparative Example C |
| 500 | 0.22 | 0.31 |
| 1000 | 0.20 | 0.19 |
| 1500 | 0.17 | 0.11 |
| 2000 | 0.15 | 0.08 |
| 2500 | 0.14 | The abrasive disc |
| 3000 | 0.13 | was spent; the |
| 3500 | 0.12 | test was stopped. |
| 4000 | 0.13 | |
| 4500 | 0.11 | |

TABLE I-continued

| | Disc Test Procedure Results Cut in grams | |
|---|---|---|
| No. of cycles | Example 7 | Comparative Example C |
| 5000 | 0.11 | |

Example 8

An abrasive article of the present invention was prepared as follows. An abrasive slurry was prepared by homogeneously mixing the following materials: 55 parts WAO having an average particle size of 1 micrometer, 2.5 parts EXB, 20.5 parts NR, 7 parts SOL, 13.5 parts isopropyl alcohol, and 1.5 parts water. A layer of EAA (50 micrometers thick) was provided on a PET film (50 micrometers thick). The EAA layer was embossed to have 25 recesses/cm arranged in a square lattice array. Each recess was in the shape of an inverted truncated cone having diameters of about 0.12 mm at the surface and 0.08 mm at its depth, which was 0.04 mm. The embossed surface was flooded with the abrasive slurry such that the abrasive slurry was present on the front surface and in the recesses of the embossed backing sheet. A doctor blade was used to remove the abrasive slurry from the front surface of the embossed backing sheet. The resulting article was then heated for 30 minutes at a temperature of 120° C. to expand and polymerize the phenolic resin. Abrasive composite members extending about 0.06 mm above the front surface of the layer of EAA were formed.

The abrasive article of the invention was tested according to the Rigid Disc Texturing Test and provided a mean value of 4.745, a peak to peak value of 0.053, and a slope of 0.064.

The abrasive article of Comparative Example A was tested by the Rigid Disc Texturing Test and had a mean value of 4.44, a peak to peak value of 0.098, and a slope of 0.148.

Example 9

An abrasive article of the present invention was prepared in the same manner as was used in Example 8, except that the embossed backing sheet had 33 recesses/cm.

The abrasive article of this example was tested according to the Rigid Disc Texturing Test and provided a mean value of 4.714, a peak to peak value of 0.053, and a slope of 0.079.

Example 10

An abrasive article of the present invention was prepared in the same manner as was used in Example 8, except that the embossed backing sheet had 40 recesses/cm. Each recess was in the shape of an inverted truncated cone, having a diameter of 0.065 mm at the bottom, a diameter of 0.09 mm at the top, and a depth of 0.025 mm.

The abrasive article of this example was tested according to the Rigid Disc Texturing Test and provided a mean value of 4.663, a peak to peak value of 0.053, and a slope of 0.064.

Example 11

An abrasive article of the present invention was prepared as follows. An abrasive slurry was prepared by homogeneously mixing the following materials: 55 parts WAO having an average particle size of 1 micrometer, 2.5 parts EXB, 20.5 parts NR, 7 parts SOL, 13.5 parts isopropyl alcohol, and 1.5 parts water. A PET film (50 micrometers thick) having a layer of EAA (50 micrometers thick) was provided. The EAA layer was embossed according to the manner used in Example 9 to have 33 recesses/cm. This embossed layer was flooded with the abrasive slurry such that the abrasive slurry was present on the front surface and in the recesses of the embossed backing sheet. A doctor blade was used to remove the abrasive slurry from the front surface of the embossed backing sheet. The resulting article was then heated for 30 minutes at a temperature of 120° C. to expand and polymerize the phenolic resin. Abrasive composite members extending about 0.06 mm above the front surface of the layer of EAA were formed.

Example 12

An abrasive article of the present invention was prepared in the same manner as was used in Example 11, except that the same type of embossed backing sheet as was used in Example 2 was used.

Example 13

An abrasive article of the present invention was prepared as follows. An abrasive slurry was prepared by homogeneously mixing the following materials: 56.5 parts WAO having an average particle size of 2 micrometer, 2.5 parts EXB, 21 parts NR, 11.7 parts isopropyl alcohol, 1.3 parts water, and 17 parts SOL. An embossed backing sheet of the type used in Example 11 was flooded with the abrasive slurry such that the abrasive slurry was present on the front surface and in the recesses of the embossed backing sheet. A doctor blade was used to remove the abrasive slurry from the front surface of the embossed backing sheet. The resulting article was then heated for 30 minutes at a temperature of 120° C. to expand and polymerize the phenolic resin. Abrasive composite members that extended 0.05 mm above the front surface of the layer of EAA were formed.

The abrasive article was tested according to the Rigid Disc Texturing Test and provided a mean value of 4.396, a peak to peak value of 0.131, and a slope of 0.22.

Example 14

An abrasive article of the present invention was prepared in the same manner as was used in Example 13, except that a different curing schedule was utilized. The abrasive slurry was dried for 30 minutes at room temperature and then cured for 30 minutes at a temperature of 120° C.

Example 15

An abrasive article of the present invention was prepared in the same manner as was used in Example 13, except that a different abrasive slurry was employed. The abrasive slurry contained 56.5 parts WAO having an average particle size of 2 micrometer, 1.5 parts EXB, 21 parts NR, 11.7 parts isopropyl alcohol, 1.3 parts water, and 17 parts SOL. Because there was less EXB, the abrasive slurry did not expand as much as did the slurry of Example 13.

The abrasive article was tested according to the Rigid Disc Texturing Test and provided a mean value of 4.417, a peak to peak value of 0.068, and a slope of 0.151.

Example 16

An abrasive article of the present invention was prepared as follows. A solution was prepared by dissolving 5 parts ethyl cellulose ("ETHOCEL STANDARD 200", commercially available from Dow Chemical) in a mixture containing 45 parts isopropyl alcohol and 5 parts water. This solution was then mixed with 22.5 parts isopropyl alcohol, 2.5 parts water, and 40 parts EXB. Next, an abrasive slurry was prepared by homogeneously mixing the following materials: 65 parts WAO having an average particle size of 2 microns, 19 parts NR, 5 parts polyester plasticizer, 7 parts SOL, 13.5 parts isopropyl alcohol, and 1.5 parts water. An embossed backing sheet of the type described in Example 11 was flooded with the mixture that contained EXB such that the mixture was present on the front surface and in the recesses of the embossed backing sheet. A doctor blade was used to remove the mixture from the front surface of the embossed backing sheet. The mixture was then allowed to dry overnight at room temperature. Upon drying, the recesses of the backing sheet contained EXB and ethyl cellulose only. The EXB and ethyl cellulose did not, however, completely fill the recesses. The embossed backing sheet was then flooded with the abrasive slurry such that the slurry was present on the front surface and filled the remainder of the recesses of the embossed backing sheet. The abrasive slurry was removed from the front surface of the embossed backing sheet by means of a doctor blade. The resulting article was then heated for five minutes at a temperature of 105° C. and then heated for 10 minutes at a temperature of 120° C. to cause the EXB to expand and polymerize the phenolic resin.

Example 17

An abrasive article of the present invention was prepared in the same manner as was used Example 16, except that the abrasive slurry contained 14 parts NR and 10 parts of a polyester plasticizer, and the article was heated for five minutes at a temperature of 105° C. and then heated for 25 minutes at a temperature of 120° C.

The abrasive article was tested according to the Rigid Disc Texturing Test and provided a mean value of 4.495, a peak to peak value of 0.107, and a slope of 0.063.

Various modifications and alterations of this invention will become apparent to those skilled in the art without departing from the scope and spirit of this invention, and it should be understood that this invention is not to be unduly limited to the illustrative embodiments set forth herein.

What is claimed is:

1. A method for manufacturing an abrasive article comprising the steps of:

A. providing an embossed backing sheet having a front surface and a back surface, said front surface having recesses formed therein, each of said recesses having side wall portions and a recessed surface portion, said side wall portions extending between said front surface and said recessed surface portion of each recess;

B. providing each of said recesses with (1) an abrasive slurry comprising a plurality of abrasive grains dispersed in a binder precursor and (2) an expanding agent;

C. activating said expanding agent to cause said abrasive slurry to increase in volume sufficiently so that said abrasive slurry expands above said front surface of said embossed backing sheet; and D. solidifying said binder precursor, whereby a plurality of abrasive composite members extending above said front surface of said embossed backing sheet are formed in said recesses.

2. The method of claim 1 wherein said embossed backing sheet comprises at least two layers.

3. The method of claim 1 wherein said embossed backing sheet is made of a polymeric film.

4. The method of claim 1 further comprising the step of applying a size coat over the front surface of said embossed backing sheet and over said abrasive composite members.

5. The method of claim 4 wherein said size coat is formed from a polymer selected from the group consisting of phenolics, acrylates, epoxies, polyesters, urea-formaldehydes, and melamine-formaldehydes.

6. The method of claim 1 wherein said side wall portions of said recesses are substantially perpendicular to said recessed surface portions.

7. The method of claim 1 wherein said recesses are unconnected.

8. The method of claim 1 wherein said recessed surface portions have a maximum dimension of 10 to 5000 micrometers.

9. The method of claim 1 wherein said abrasive composite members comprise 5 to 95 percent by weight abrasive grains.

10. The method of claim 1 wherein said binder precursor is selected from the group consisting of phenolic resins, acrylate resins, epoxy resins, polyester resins, urea-formaldehyde resins, and melamine-formaldehyde resins.

11. The method of claim 1 wherein said recesses are unconnected and have an area spacing such that there are 2 to 10,000 recesses/$cm^2$.

12. The method of claim 11 wherein said recesses have an area spacing such that there are 100 to 10,000 recesses/$cm^2$.

13. The method of claim 1 wherein said recesses are elongated and have a linear spacing such that there are 2 to 100 recesses/cm.

14. The method of claim 1 wherein said embossed backing sheet is a flexible polymeric sheet having a thickness of 10 to 1000 micrometers.

15. The method of claim 14 wherein said embossed backing sheet is selected from the group consisting of polyethylene terephthalate film, polyethylene terephthalate film coated with ethylene acrylic acid copolymer, polypropylene, and paper coated with ethylene acrylic acid copolymer.

16. The method of claim 1 wherein said abrasive grains have an average size of 0.1 to 1000 micrometers.

17. The method of claim 1 wherein said expanding agent is a substance capable of increasing the volume occupied by the abrasive slurry.

18. The method of claim 17 wherein said expanding agent is a member selected from the group consisting of steam, organic solvent capable of swelling the abrasive slurry, expanding bead, and gas.

19. The method of claim 1 wherein expansion of said abrasive slurry is controlled to provide abrasive composite members having uniformity in height.

20. An abrasive article comprising:

an embossed backing sheet having a front surface and a back surface, said front surface having a plurality of recesses formed therein, each of said recesses having a side wall portion and a recessed surface portion, the side wall portion extending between the front surface and the recessed surface portion of each recess;

a plurality of abrasive composite members positioned in said recesses, such that a maximum of one abrasive composite member is positioned in each recess, said abrasive composite members extending above the front surface of said embossed backing sheet, each of said abrasive composite members surrounded by a region free of abrasive composite members, said abrasive composite members comprising abrasive grains dispersed in a binder.

21. The abrasive article of claim 20 wherein said recesses have a planar configuration having a shape selected from the group consisting of circles, squares, rectangles, and triangles.

22. The abrasive article of claim 20 further including a size coat provided over said embossed backing sheet and said abrasive composite members.

23. The abrasive article of claim 22 wherein said size coat comprises a material selected from the group consisting of phenolic resins, acrylate resins, epoxy resins, polyester resins, urea-formaldehyde resins, and melamine-formaldehyde resins.

24. The abrasive article of claim 20 wherein said abrasive composite members are unconnected and have an average area spacing such that there are 2 to 10,000 members/$cm^2$.

25. The abrasive article of claim 24 wherein said abrasive composite members have an average area spacing such that there are 100 to 10,000 members/$cm^2$.

26. The abrasive article of claim 25 wherein said abrasive composite members are arranged in a regular array of regularly spaced rows and regularly spaced columns.

27. The abrasive article of claim 20 wherein said abrasive composite members have a an elongated shape and have a linear spacing of 2 to 100 members/cm.

28. The abrasive article of claim 20 wherein said abrasive composite members contain from 5 to 95 percent by weight abrasive grains.

29. The abrasive article of claim 20 wherein said embossed backing sheet has a thickness of 10 to 1000 micrometers.

30. The abrasive article of claim 29 wherein said side wall portion of said recesses has a height of 10 to 100 micrometers.

31. The abrasive article of claim 29 wherein the material of said embossed backing sheet is selected from the group consisting of paper, polymeric film, fiber, and non-woven materials, coated combinations thereof, and treated combinations thereof.

32. The abrasive article of claim 20 wherein said abrasive composite members are uniform in height.

33. The abrasive article of claim 20 wherein the top surface of said abrasive composite members has a pattern thereon.

34. The abrasive article of claim 20 wherein said abrasive composite members have a maximum dimension of 10 to 5000 micrometers.

35. An abrasive article comprising:

an embossed backing sheet having a front surface, a back surface, and a plurality of recesses extending completely through said embossed backing sheet, said recesses including a side wall portion extending from the front surface to the back surface of said embossed backing sheet;

a plurality of abrasive composite members positioned in said recesses, such that a maximum of one abrasive composite member is positioned in each recess, said abrasive composite members extending above both the front surface and the back surface of said embossed backing sheet, each of said abrasive composite members surrounded by a region free of abrasive composite members, said abrasive composite members comprising abrasive grains dispersed in binder.

36. The method of claim 1, wherein said expanding agent and said abrasive slurry are provided to said recesses simultaneously.

37. The method of claim 1, wherein said expanding agent and said abrasive slurry are provided to said recesses sequentially.

38. A method for manufacturing an abrasive article comprising the steps of:

A. providing an embossed backing sheet having a front surface and a back surface, said backing sheet having recesses formed therein, each of said recesses having side wall portions, said side wall portions of each recess extending from said front surface to said back surface of said backing sheet;

B. providing each of said recesses with (1) an abrasive slurry comprising a plurality of abrasive grains dispersed in a binder precursor and (2) an expanding agent;

C. activating said expanding agent to cause said abrasive slurry to increase in volume sufficiently so that said abrasive slurry expands above said front surface of said embossed backing sheet and below said back surface of said embossed backing sheet; and D. solidifying said binder precursor, whereby a plurality of abrasive composite members extending above said front surface of said embossed backing sheet and below said back surface of said embossed backing sheet are formed in said recesses.

39. The method of claim 38 further comprising the step of applying a size coat over said back surface of said embossed backing sheet and over said abrasive composite members.

40. The method of claim 38 further comprising the step of applying a size coat over said back surface of said embossed backing sheet and over said abrasive composite members.

* * * * *